United States Patent [19]

Bruning et al.

[11] Patent Number: 4,810,374

[45] Date of Patent: Mar. 7, 1989

[54] SELF-EMPTYING CENTRIFUGE DRUM

[75] Inventors: Paul Bruning; Werner Kohlstette, both of Oelde, Fed. Rep. of Germany

[73] Assignee: Westfalia Separator AG, Oelde, Fed. Rep. of Germany

[21] Appl. No.: 187,122

[22] Filed: Apr. 28, 1988

[30] Foreign Application Priority Data

May 20, 1987 [DE] Fed. Rep. of Germany ..... 3716900

[51] Int. Cl.[4] ..... B04B 11/00

[52] U.S. Cl. ..... 210/104; 210/360.1; 210/374; 210/380.1

[58] Field of Search ..... 210/86, 103, 104, 114, 210/360.1, 360.2, 369–375, 380.1, 382

[56] References Cited

U.S. PATENT DOCUMENTS 3,642,196 2/1972 Nilsson ..... 210/371 X
4,305,817 12/1981 Kohlstette ..... 210/104
4,695,270 9/1987 Zettier ..... 210/360.1 X

*Primary Examiner*—Charles Hart
*Attorney, Agent, or Firm*—Sprung Horn Kramer & Woods

[57] ABSTRACT

A self-emptying centrifuge drum has an intake for the centrifugate, a peeling chamber that accommodates a peeling disk for diverting the clarified liquid, and an automatic device that senses the level of solids in the separating space of the drum. The sensing device consists of channels extending from the separating space to another peeling chamber with another peeling disk. The outflow channel from the second peeling disk communicates with a measuring instrument that operates in conjunction with controls that introduce the extracted solids into the drum. Peeling channels are provided in the second peeling disk, extending out from its circumference and opening tangentially into an annular space that does not have any ribs and that extends radially inside the disk to detect the level of solids in the separating space even when centrifugates that do not block the channels sufficiently are being clarified.

3 Claims, 1 Drawing Sheet

SELF-EMPTYING CENTRIFUGE DRUM

BACKGROUND OF THE INVENTION

The invention concerns a self-emptying centrifuge drum with an intake for the centrifugate, a peeling chamber that accommodates a peeling disk for diverting the clarified liquid, and an automatic device that senses the level of solids in the separating space of the drum and that consists of channels extending from the separating space to another peeling chamber with another peeling disk, whereby the outflow channel from the second peeling disk communicates with a measuring instrument that operates in conjunction with controls that introduce the extracted solids into the drum.

A centrifuge drum of this type is known from German Pat. No. 2 926 237. It is employed to initiate automatic incomplete or complete emptying processes in the drum once a prescribed volume of solids has accumulated in the separating space of the drum. For this purpose a slight proportion of water is constantly diverted into a peeling chamber having a peeling disk through one or more channels extending from the separating space while clarification is proceeding in the drum. The liquid deriving from the peeling disk s supplied to a measuring instrument, a flowmeter for example. The flowmeter is connected to controls that initiate complete or incomplete emptying of the drum when the flow through the flowmeter decreases below a certain threshold. The flow through the flowmeter decreases when enough centrifuged solids have accumulated in the separating space to block the channels.

It is known that centrifuge drums of this type cannot be employed with all types of solids. There are solids that never become dense enough to block the channels. The signal for initiating incomplete or complete emptying will arrive either too late or not at all. The channels are particularly difficult to block with bacterial suspensions, and the solids are likely to arrive in the second peeling chamber along with the extracted liquid through the channels and be diverted out over the peeling disk accommodated therein.

SUMMARY OF THE INVENTION

The object of the present invention is accordingly to improve the known self emptying centrifuge drum to the extent that it will be possible to detect the level of solids in the separating space even when centrifugates that do not block the channels sufficiently are being clarified.

This object is attained by an improvement wherein peeling channels are provided in the second peeling disk, extending out from its circumference and opening tangentially into an annular space that does not have any ribs and that extends radially inside the disk.

The liquid extracted from the separating space is supplied tangentially to the ribless annular space through the channels in the second peeling disk and accordingly induced to rotate. This measure opposes additional impedance to the flow through the annular space and accordingly keeps the flow relatively low. As soon as the level of solids in the separating space arrives in the channels, solids begin to be extracted along with the liquid and supplied to the ribless annular space. The viscosity of the liquid extracted through the channels will increase with the percentage of solids. The resulting increase in the friction of the liquid will brake the rotation of the liquid in the ribless annular space and hence the impedance created by the space. The resulting increase in the volume of solids conveyed through the second peeling disk is detected by the measuring instrument and can be processed to initiate incomplete or complete emptying of the centrifuge drum.

In one practical embodiment of the invention, the measuring instrument communicates with the intake into the centrifuge drum. The liquid is accordingly returned with the solids in it back to the drum and clarified again.

In another practical embodiment of the invention there is a diversion mechanism downstream of the measuring instrument that can interrupt the communication with the intake and establish a communication with a line to where the solids are extracted. In this embodiment the liquid deriving from the second peeling disk at the beginning of the clarification process is initially returned to the intake into the drum. As the viscosity and hence the volume of liquid increases, the measuring instrument activates the diversion mechanism, and, if the solids phase contains a high level of solids, it is diverted to a line that extracts them. This makes it possible to process even large volumes of solids without having to empty the drum too frequently. Incomplete and complete emptying can accordingly also be initiated as a function of time to ensure optimal cleaning of the drum.

One embodiment of the invention will now be specified with reference to the drawing, wherein:

DETAILED DESCRIPTION OF THE INVENTION

Figure 1:
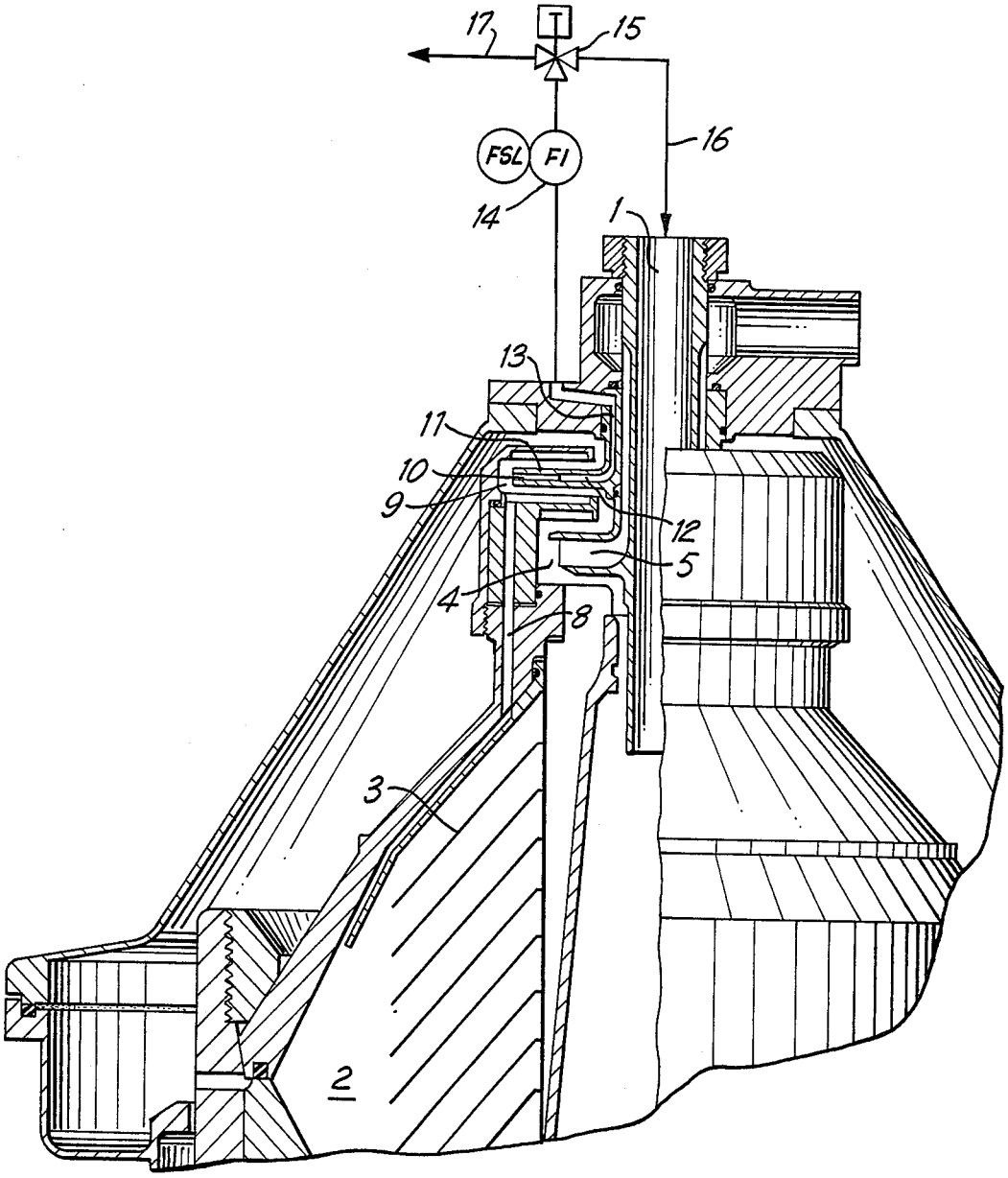
FIG. 1 is a section through part of a self-emptying centrifuge drum according to the invention.
Figure 2:
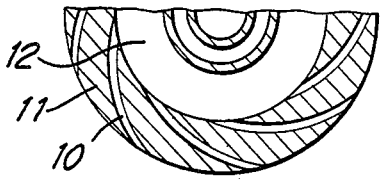
FIG. 2 is a section through part of the second peeling disk of FIG. 1 in the vicinity of the ribless annular space.

Referring now to FIGS. 1 and 2, liquid that contains a percentage of solids is supplied through an intake 1. Once the liquid has entered the drum and the centrifuged solids are accumulating in a separating space 2, the clarified liquid flows through a stack 3 of disks into a peeling chamber 4, where it is diverted out over a peeling disk 5 accommodated therein.

A slight percentage of the clarified liquid is extracted from separating space 2 through channels 8 during the operation and arrives, by way of another peeling chamber 9 and of peeling channels 10 in another peeling disk 11, in a ribless annular space 12 and thence, by way of a diversion channel 13, in a measuring instrument 14 downstream of a diversion mechanism 15. From diversion mechanism 15 a line 16 leads back into intake 1. The solids are extracted through another line 17.

At the beginning of the process and due to the high impedance on the part of annular space 12, only a small percentage of liquid will initially flow out of separating space 2, through channels 8, peeling channels 10, and annular space 12 into measuring instrument 14, which can be a flowmeter with two thresholds. The low flow rate will trigger only the lower threshold in measuring instrument 14, which will accordingly set diversion mechanism 15 to return the liquid back into the intake 1 into the drum. As soon as the level of solids in the separating space arrives at channels 8, solids will also flow through the channels and through peeling channels 10 into annular space 12, and the increasing viscosity will decrease the rotation of the liquid in the space and hence the flow impedance. The rate of flow through the diversion channel 13 in second peeling disk 11 will increase, and the upper threshold in measuring instrument 14 will be attained. The resulting signal can be exploited either to initiate extraction of solids in the drum by way of unillustrated controls or to activate diversion mechanism 15 and introduce solids that are now being diverted by way of second peeling disk 11 into line 17, thorough which they are extracted. Once the solids have been diverted out of the drum for a prescribed amount of time, the drum can be incompletely or completely emptied in order for example to improve its clarifying action. Since liquid without any solids content will initially be extracted by way of second peeling disk 11 subsequent to emptying and since the volume of solids initially extracted will accordingly be small, measuring instrument 14 will reset diversion mechanism 15 and the liquid will again initially flow into the intake 1 into the drum until the level of solids in the separating space 2 of the drum arrives at channels 8.

It will be appreciated that the instant specifications and claims are set forth by way of illustration and not limitation, and that various modifications and changes may be made without departing from the spirit and scope of the present invention.

What is claimed is:

1. In a self-emptying centrifuge drum with an intake for centrifugate, a first peeling chamber accommodating a first peeling disk for diverting clarified liquid, means for sensing the level of solids in a separating space of the drum including a second peeling chamber with a second peeling disk and an outflow channel, channels extending from the separating space to the second peeling chamber and measuring means in communication with the outflow channel of the second peeling disk, and means responsive to the measuring means for controlling the introduction of extracted solids into the drum, the improvement wherein the second peeling disk has means forming an annular space extending radially inwardly of the disk and having no ribs, and means forming peeling channels in the second peeling disk, extending from its circumference and opening tangentially into the annular space.

2. The self-emptying centrifuge drum as in claim 1, wherein the measuring means communicates with the intake into the centrifuge drum.

3. The self-emptying centrifuge drum as in claim 2, wherein the control means includes a diversion mechanism downstream of the measuring means for interrupting the communication with the intake and establishing a communication with a line to where the solids are extracted.

* * * * *